US008617036B2

(12) United States Patent
Chen

(10) Patent No.: US 8,617,036 B2
(45) Date of Patent: Dec. 31, 2013

(54) BARBELL ASSEMBLY

(76) Inventor: Jih-Ming Chen, Taichung (TW)

( * ) Notice: Subject to any disclaimer, the term of this patent is extended or adjusted under 35 U.S.C. 154(b) by 174 days.

(21) Appl. No.: 13/283,338

(22) Filed: Oct. 27, 2011

(65) Prior Publication Data

US 2013/0109545 A1 May 2, 2013

(51) Int. Cl.
*A63B 21/072* (2006.01)

(52) U.S. Cl.
USPC ..... 482/107; 482/50; 482/93; 482/104; 482/106; 482/108

(58) Field of Classification Search
USPC ..... 482/106–108, 93, 104, 49, 50, 132
See application file for complete search history.

(56) References Cited

U.S. PATENT DOCUMENTS

| | | | | |
|---|---|---|---|---|
| 6,770,016 | B1 * | 8/2004 | Anderson et al. | 482/106 |
| 7,131,938 | B2 * | 11/2006 | Cao | 482/106 |
| 2003/0232705 | A1 * | 12/2003 | Harms et al. | 482/108 |
| 2007/0249475 | A1 * | 10/2007 | Cao | 482/107 |
| 2009/0270233 | A1 * | 10/2009 | Cao | 482/108 |

* cited by examiner

*Primary Examiner* — Loan Thanh
*Assistant Examiner* — Nyca T Nguyen

(57) ABSTRACT

A barbell assembly includes an axle having two connection holes respectively defined in two ends thereof and two outer tubes are respectively mounted to the two ends of the axle. Each outer tube has a space and two collars are respectively located in the two spaces of the two outer tubes. The two collars are respectively mounted to the two ends of the axle. Two locking units each include a control ring, a locking member and a cap. The control ring is located in the space of the outer tube corresponding thereto. Each locking member has an engaging portion which extends through the control ring and is connected with the connection hole of the axle. The cap is fixed to the outer tube and presses the control ring to contact against the collar and the axle.

2 Claims, 6 Drawing Sheets

BARBELL ASSEMBLY

FIELD OF THE INVENTION

The present invention relates to a barbell assembly, and more particularly, to a barbell assembly with a stable construction relationship between the parts thereof.

BACKGROUND OF THE INVENTION

A conventional barbell assembly is shown in FIG. 6 and generally includes an axle 61, two outer tubes 62, two sleeves 63 and two locking members 64. The axle 61 has two connection holes 611 respectively defined in two ends thereof. The two outer tubes 62 are respectively mounted to the two ends of the axle 61 and each outer tube 62 has a collar 621 located therein. The outer surfaces of the distal end of each of the two ends of the axle 61 are mounted by the collar 621 and a reception space 622 is defined in the inner periphery of each of the outer tubes 62. Two sleeves 63 are respectively inserted into the two outer tubes 62 and two distal ends of the two sleeves 63 respectively contact two shoulders at the inner ends of the two outer tubes 62, the two respective distal ends of the axle 61 and the two collars 621. The two locking members 64 each have an engaging portion 641 which extends through the passage 631 of the sleeve 63 corresponding thereto, the locking members 64 are respectively threadedly connected to the connection holes 611 of the axle 61. The sleeves 63 and the outer tubes 62 are soldered together from outside of the two ends of the barbell assembly as disclosed by black triangular portions.

However, the engagement between the reception spaces 622 and the sleeves 63 requires highly precision of machining due to the large contact area between the reception spaces 622 and the sleeves 63 so as to avoid from a gap between the sleeves 63 and the reception spaces 622. If the sizes of the sleeves 63 are too big for the reception spaces 622, the sleeves 63 cannot be inserted into the reception spaces 622. If the sleeves 63 are too small, a gap is defined between the sleeves 63 and the reception spaces 622. The gap may cause the sleeves 63 to be tilt relative to the axis of the axle 61, and this affects the rotation of the outer tubes 62 relative to the axle 61. Similarly, when the engaging portion 641 of each of the locking members 64 is inserted into the passage 631 of each of the sleeves 63, a proper gap is ensured to exist between the head of the locking member 64 and the sleeve 63 after the locking member 64 is fixed to the axle 61, such that the gap allows the outer tube 62 to be rotated. The gap is difficult to be controlled so that the sleeve 63 is tightly connected to the axle 61 by the locking member 64, the outer tube 62 cannot smoothly rotate. Therefore, the sleeves 63 require precisely machined. Besides, in order to prevent the sleeves 63 from being loosened when putting the barbell assembly to the floor after each lift, the sleeves 63 are soldered to the outer tubes 62, the soldering processes needs a lot of laboring and cost.

The present invention intends to provide a barbell assembly which is improves the shortcomings of the conventional barbell assembly.

SUMMARY OF THE INVENTION

The present invention relates to a barbell assembly and comprises an axle having two connection holes respectively defined in two ends thereof and two outer tubes are respectively mounted to the two ends of the axle. Each outer tube has a space and two collars are respectively located in the two spaces of the two outer tubes. The two collars are respectively mounted to the two ends of the axle. Two locking units each include a control ring, a locking member and a cap. The control ring is located in the space of the outer tube corresponding thereto. Each locking member has an engaging portion which extends through the control ring and is connected with the connection hole of the axle. The cap is fixed to the outer tube and presses the control ring to contact against the collar and the axle.

The primary object of the present invention is to provide a barbell assembly wherein the area of the outer surface of the control ring is small so that the machining is easy. The control ring is located in the space of the outer tube and the cap presses the control ring to contact against the collar and the axle to secure the combination, no soldering step is needed. This allows the assemblers to remove the cap to adjust the gap when needed.

Another object of the present invention is to provide a barbell assembly wherein the control ring and the cap are two individual parts which are easily made and controlled their sizes. On the contrary, for the conventional barbell assembly, the sleeves have to be machined precisely in axial direction to prevent the outer tubes from being stocked due the tilt of the sleeves.

Yet another object of the present invention is to provide a barbell assembly wherein the control ring and the cap are assembled without soldering so as to reduce the manufacturing cost.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
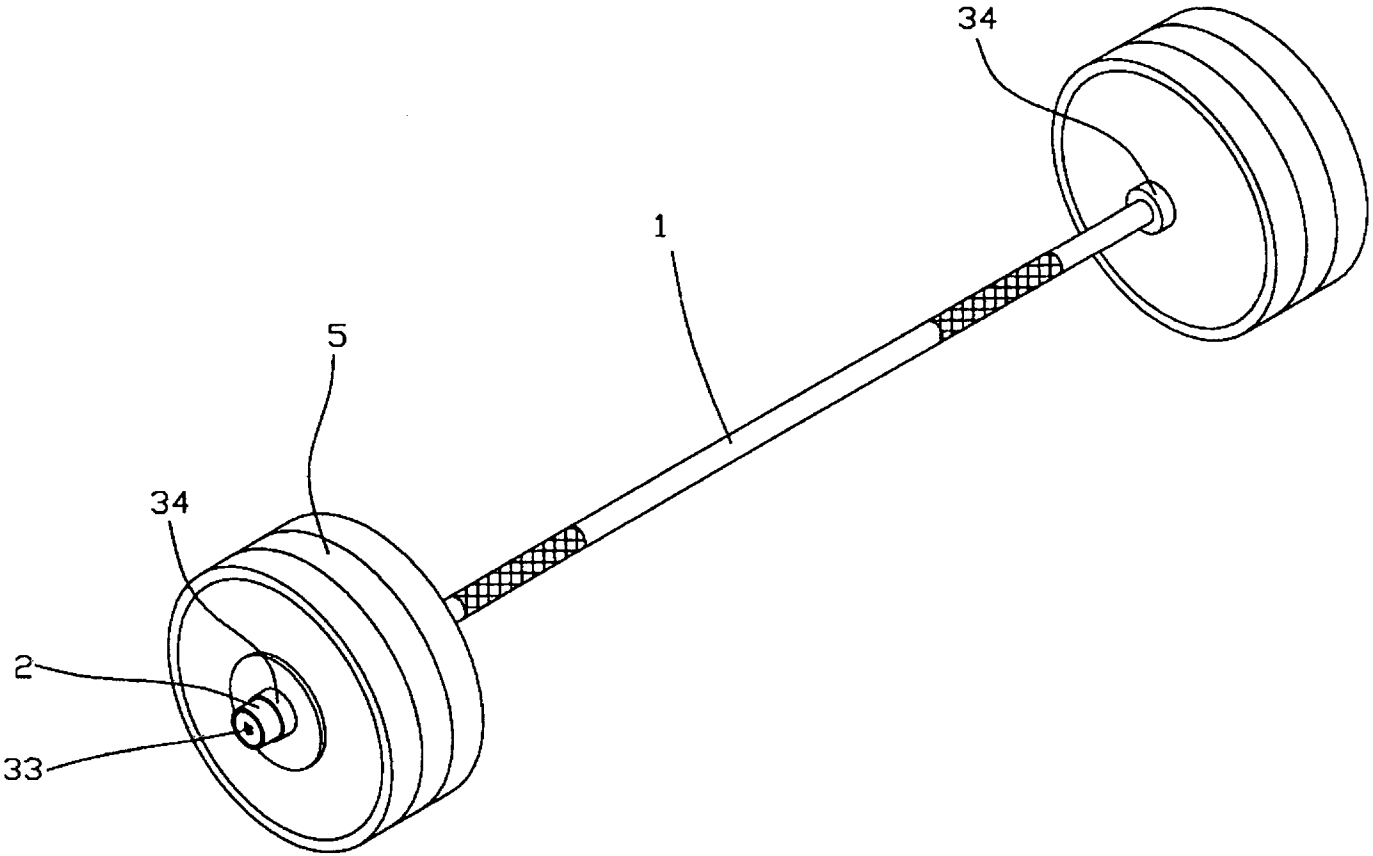
FIG. 1 is a perspective view to show the barbell assembly of the present invention.
Figure 2:
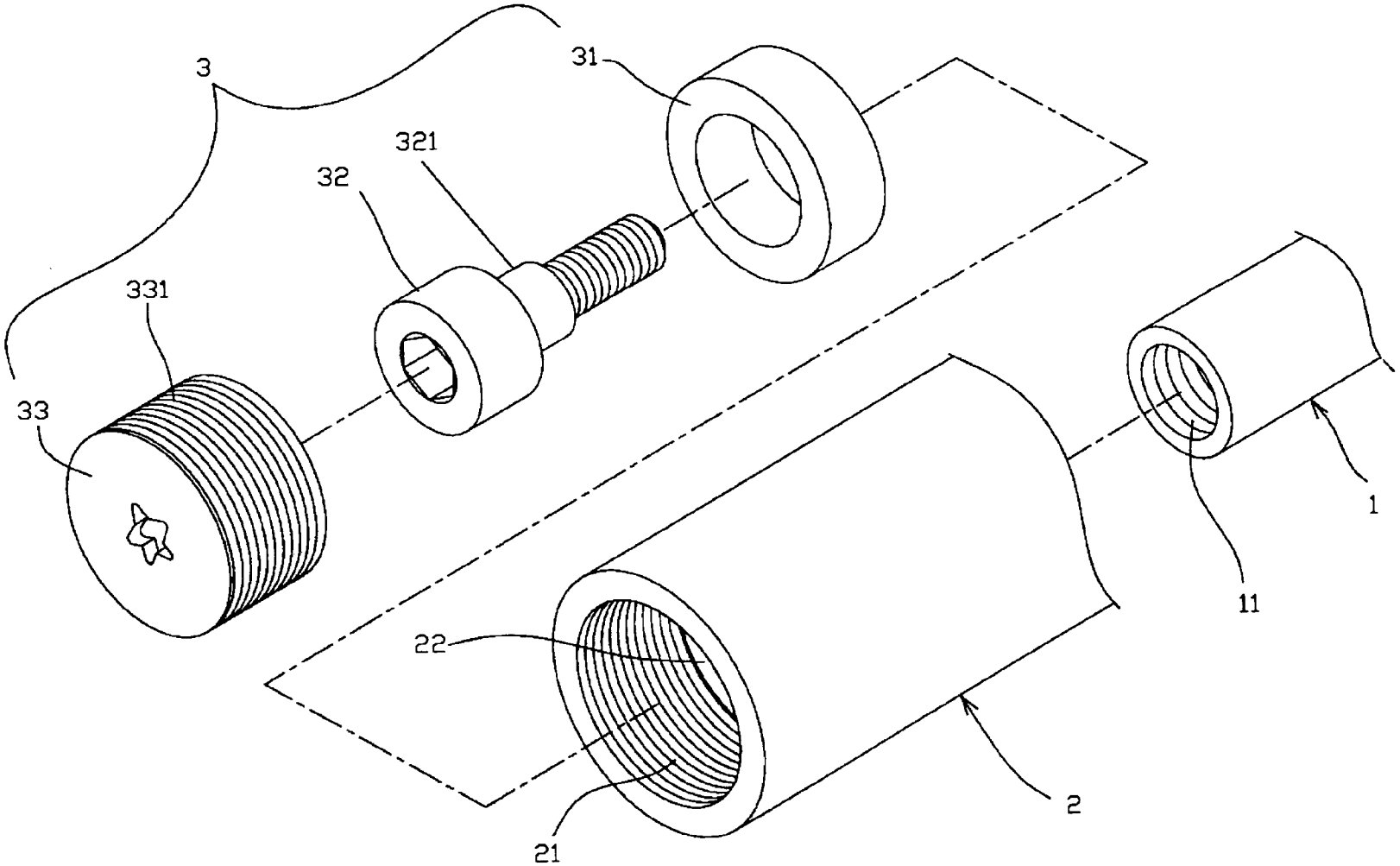
FIG. 2 is an exploded view to show the barbell assembly of the present invention.
Figure 3:
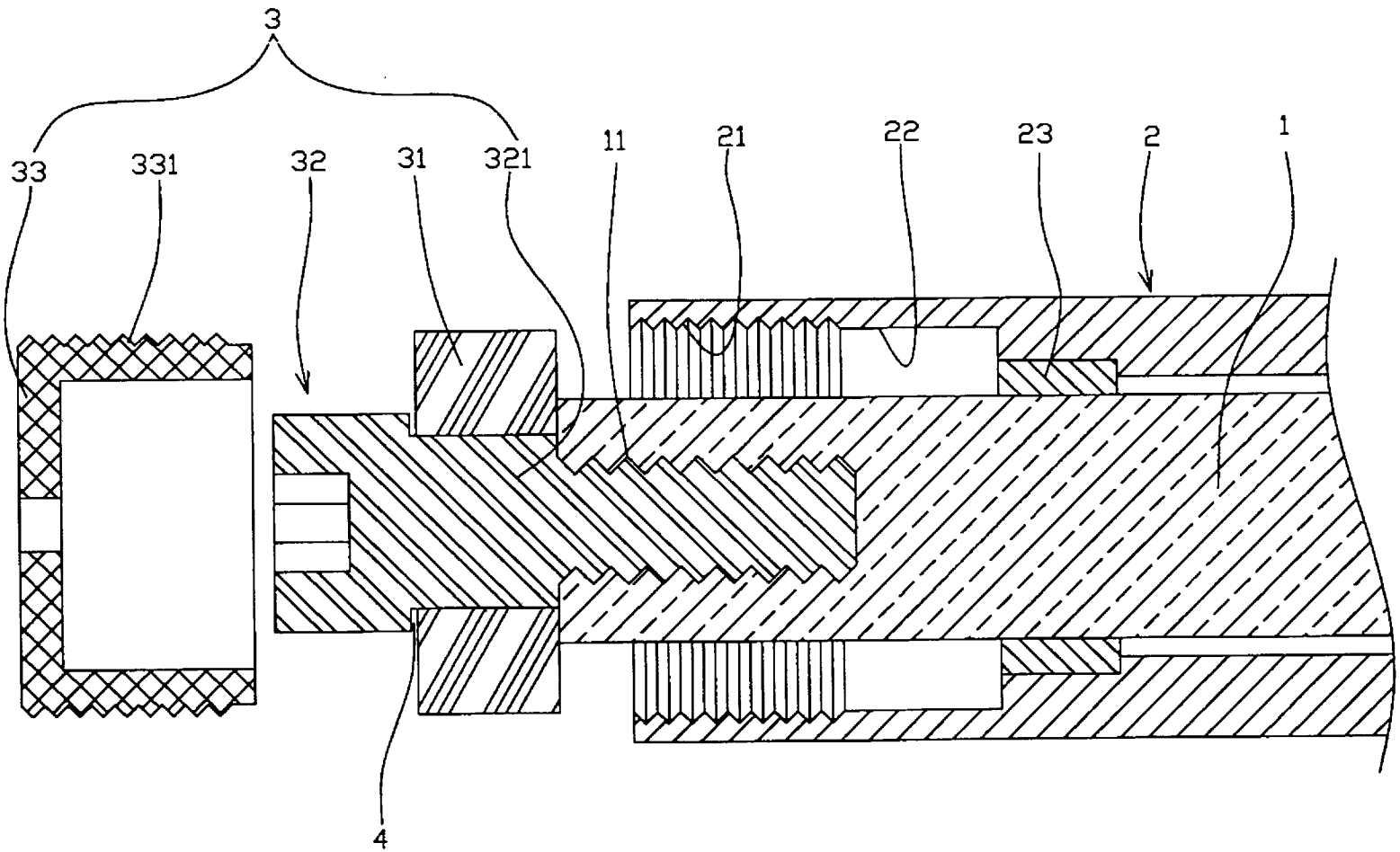
FIG. 3 is a cross sectional view of the barbell assembly of the present invention.
Figure 4:
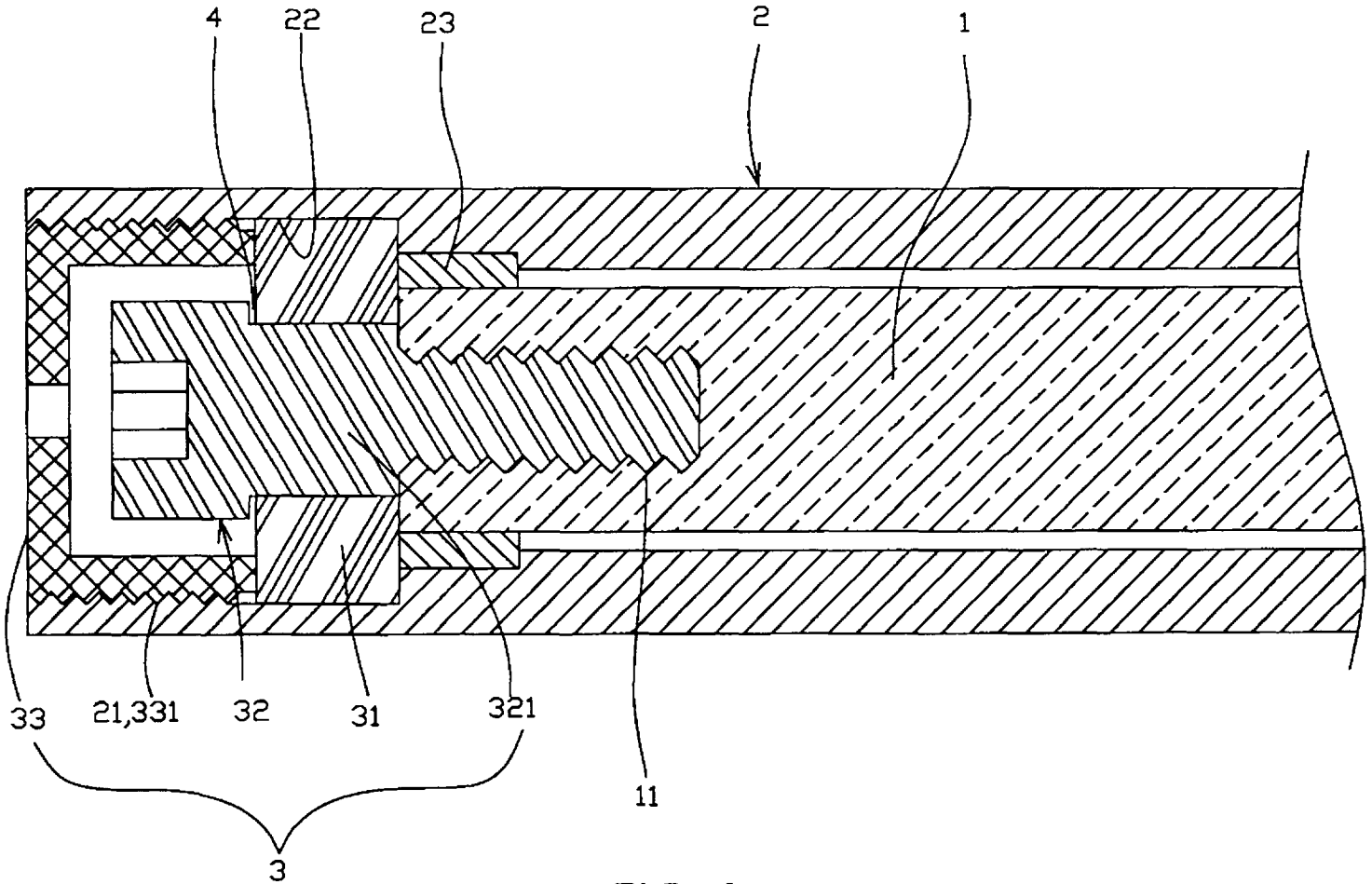
FIG. 4 is another cross sectional view of the barbell assembly of the present invention.

Referring to FIGS. 1 to 5, the barbell assembly of the present invention comprises an axle 1 having two connection holes 11 respectively defined in two ends thereof. Two outer tubes 2 are respectively mounted to the two ends of the axle 1 and weights 5 are mounted to the two outer tubes 2. Each outer tube 2 has inner threads 21 defined therein which are located close to the distal end thereof. A space 22 is defined in each of the two outer tubes 2 and two collars 23 are respectively located in the spaces 22 of the two outer tubes 2. The two collars 23 are respectively mounted to the two ends of the axle 1.

Figure 5:
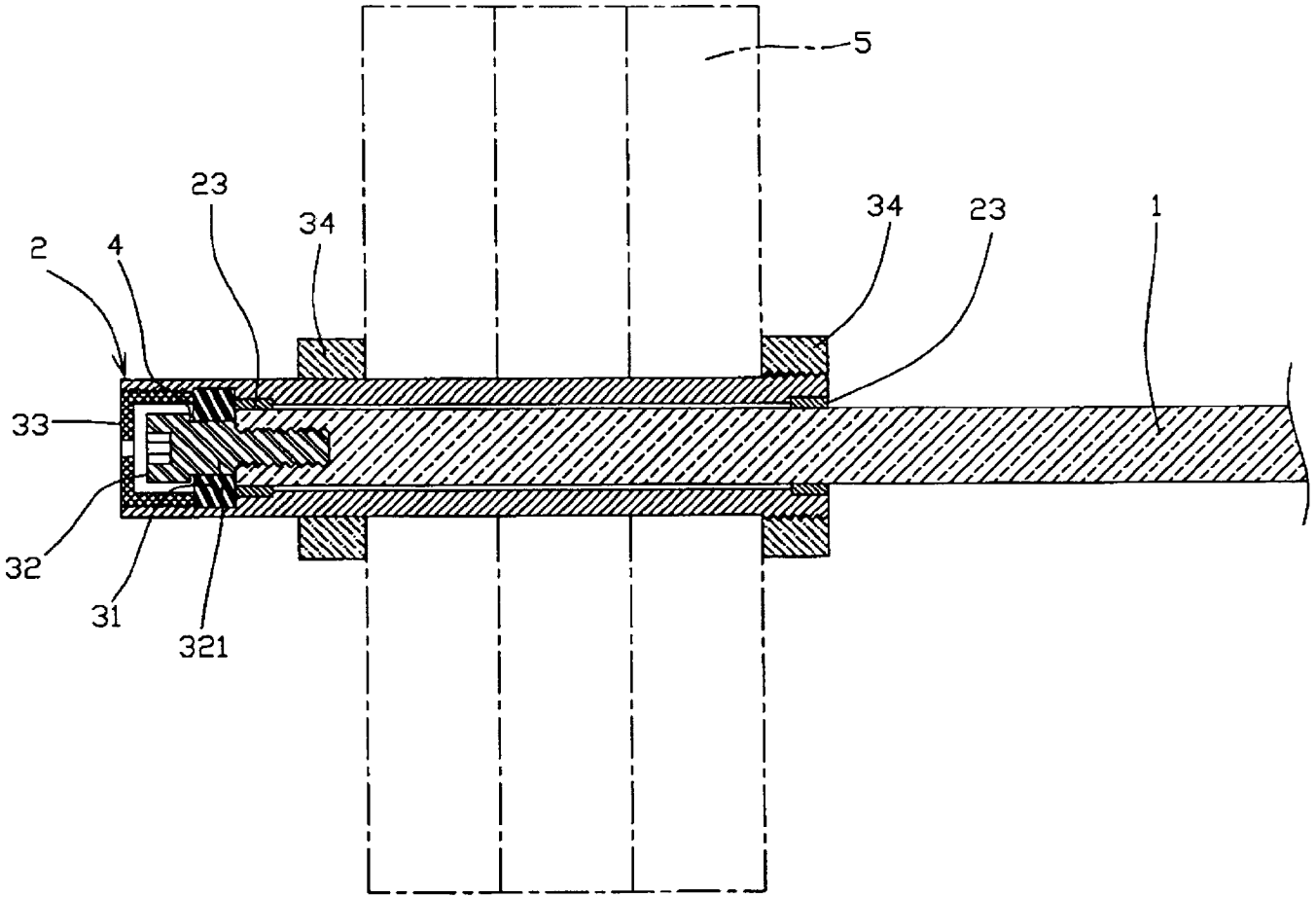
FIG. 5 is a cross sectional view to show that weights are connected to the barbell assembly of the present invention.
Figure 6:
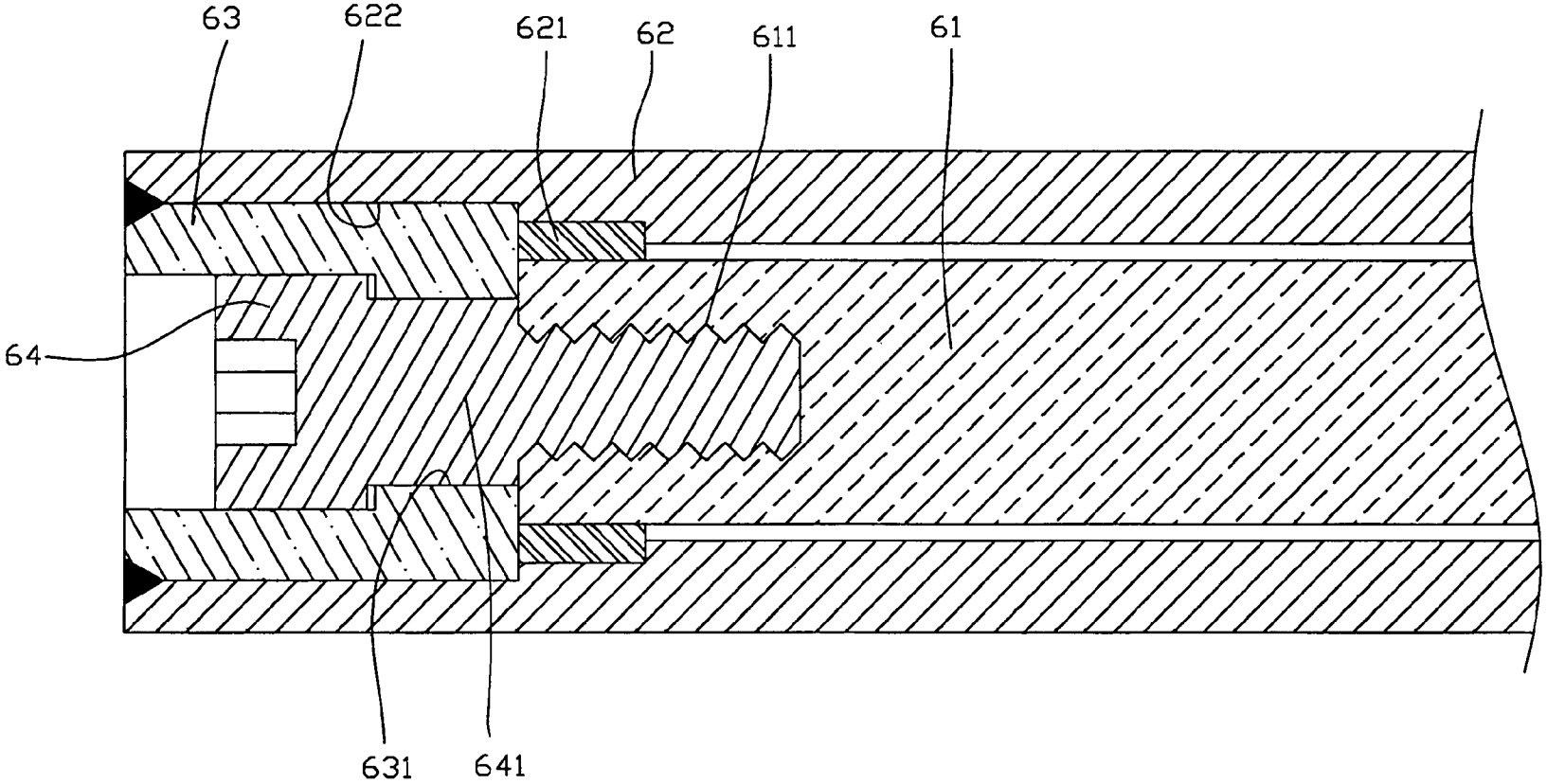
FIG. 6 PRIOR ART
FIG. 6 is a cross sectional view to show the conventional barbell assembly.

Two locking units 3 each have a control ring 31, a locking member 32 and a cap 33. The control ring 31 is located in the space 22 of the outer tube 2 corresponding thereto. Each locking member 32 has an engaging portion 321 which extends through the control ring 31 and connected with the connection hole 11 of the axle 1. The length of the engaging portion 321 of each of the locking members 32 is larger than a thickness of the control ring 31 corresponding thereto so as to define a gap 4 between the engaging portion 321, the control ring 31 and a head of the locking member 32. Each of the caps 33 has outer threads 331 which are located on outside of each of the caps 33. The outer threads 331 are connected to the inner threads 21 of the outer tube 2 so as to fix the cap 33 to the outer tube 2 and the cap 33 presses the control ring 31 to contact against the collar 23 and the axle 1. The two fixing members 34 are mounted to each of the two outer tubes 2 and the weights 5 are secured between the fixing members 34 as shown in FIG. 5.

The two outer tubes 2 each have one fixing member 34 connected to one end thereof and the two outer tubes 2 are mounted to the two ends of the axle 1. The two outer tubes 2 are moved toward each other so that the distal ends of axle 1 are exposed. The two respective engaging portions 321 of the locking members 32 extend through the two control rings 31 respectively and the locking members 32 are connected with the connection holes 11 of the axle 1. The length of the engaging portion 321 of each of the locking members 32 is slightly larger than the thickness of the control ring 31 corresponding thereto so as to define a gap 4 between the engaging portion 321, the control ring 31 and a head of the locking member 32. The two outer tubes 2 are then moved outward to send the control rings 31 in the spaces 22 of the outer tubes 2. The outer threads 331 of the caps 33 are connected to the inner threads 21 of the outer tubes 2 so as to fix the caps 33 to the outer tubes 2. The caps 33 each press the control ring 31 to contact against the collar 23 and the axle 1. The weights 5 are then mounted to the outer tubes 2 and the other fixing member 34 then contacts against the weights 5 as shown in FIG. 5.

When lifting the barbell assembly by holding the axle 1, the wrists rotate to rotate the outer tubes 2 by the existence of the gaps 4 so that the outer tubes 2 together with the weights 5 rotate. Because the caps 33 and the control rings 31 are individual parts so that the machining to the control rings 31 is easy. The caps 33 pushes the control rings 31 to contact against the collars 23 and the axle 1 so as to prevent the locking members 32 from too tightly connecting the axle 1 and the outer tubes 2 can be smoothly rotated.

The area of the outer surface of the control ring 31 is small so that the machining is easy. The control ring 31 is located in the space 22 of the outer tube 2 and the cap 33 presses the control ring 31 which contact against the collar 23 and the axle 1 to secure the combination, no soldering step is needed. This allows the assemblers to remove the cap 33 to adjust the gap 4 when needed. The control ring 31 and the cap 33 are two individual parts which are easily made and controlled their sizes. On the contrary, for the conventional barbell assembly, the sleeves 63 have to be machined precisely in axial direction to prevent the outer tubes 62 from being stocked due the tilt of the sleeves 63. The control ring 31 and the cap 33 are assembled without soldering so as to reduce the manufacturing cost.

While we have shown and described the embodiment in accordance with the present invention, it should be clear to those skilled in the art that further embodiments may be made without departing from the scope of the present invention.

What is claimed is:

1. A barbell assembly comprising:

an axle having two connection holes respectively defined in two ends thereof;

two outer tubes rotatably mounted to the two ends of the axle and each outer tube having a space defined therein, two collars respectively located in the spaces of the two outer tubes, the two collars respectively mounted to the two ends of the axle, and two locking units each having a control ring, a locking member and a cap, the control ring located in the space of the outer tube corresponding thereto, each locking member having an engaging portion which extends through the control ring, a length of the engaging portion of each of the locking members being larger than a thickness of the control ring corresponding thereto so as to define a gap between the engaging portion, the control ring and a head of the locking member, which is configured to allow rotation of the outer tube together with weights mounted to the outer tube, each locking member is connected with the connection hole of the axle corresponding thereto, the cap fixed to the outer tube and pressing the control ring to contact against the collar and the axle; wherein each of the outer tubes has inner threads which arc located close to a distal end thereof.

2. The barbell assembly as claimed in claim 1, wherein each of the caps has outer threads which are located on an outside of each of the caps, the outer threads are connected to the inner threads of the outer tube.

* * * * *